US006671657B2

(12) United States Patent
Shigehara et al.

(10) Patent No.: US 6,671,657 B2
(45) Date of Patent: Dec. 30, 2003

(54) METHOD FOR CALCULATING CHARACTERISTIC CURVE OF CENTRIFUGAL FLUID MACHINE BY COMPUTER

(75) Inventors: Shinichi Shigehara, Tokyo (JP); Junji Maruyama, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/169,862

(22) PCT Filed: Jan. 12, 2001

(86) PCT No.: PCT/JP01/00129

§ 371 (c)(1),
(2), (4) Date: Oct. 17, 2002

(87) PCT Pub. No.: WO01/51816

PCT Pub. Date: Jul. 19, 2001

(65) Prior Publication Data

US 2003/0060989 A1 Mar. 27, 2003

(30) Foreign Application Priority Data

Jan. 12, 2000 (JP) ..... 2000-003313
Jan. 12, 2000 (JP) ..... 2000-003314

(51) Int. Cl.[7] ..... G05B 13/02
(52) U.S. Cl. ..... 702/183; 73/152.18
(58) Field of Search ..... 702/183, 11, 12, 702/45, 50, 100; 73/1.02, 1.73, 1.87, 53.01, 152.18, 152.25, 700

(56) References Cited

U.S. PATENT DOCUMENTS 4,120,033 A * 10/1978 Corso et al. ..... 702/47
6,529,782 B1 * 3/2003 Danz et al. ..... 700/34

FOREIGN PATENT DOCUMENTS

JP 2-86993 3/1990
JP 9-317623 12/1997

OTHER PUBLICATIONS

Pump no Jouzuna Tsukaikata, (Japan), Kabushiki Kaisha Power K.K., Sep. 10, 1989 , pp.28–63.

* cited by examiner

*Primary Examiner*—Marc S. Hoff
*Assistant Examiner*—Edward Raymond
(74) *Attorney, Agent, or Firm*—Wenderoth, Lind & Ponack, L.L.P.

(57) ABSTRACT

A computer-implemented method of calculating various types of characteristic curves of a centrifugal fluid machine according to the present invention can easily calculate a Q-H characteristic curve, a Q-E characteristic curve, a Q-NPSH characteristic curve, or the like. The method of calculating various types of characteristic curves uses two prescribed characteristic curves $\mathbf{Y1}=a_{11}+a_{12}x+a_{13}x^2+\ldots+a_{1n}x^{(n-1)}$ and $\mathbf{Y2}=a_{21}+a_{22}x+a_{23}x^2+\ldots+a_{2n}x^{(n-1)}$ formed of high-order equations for a centrifugal fluid machine to calculate a characteristic curve $\mathbf{Y3}=b_1+b_2x+b_3x^2+\ldots+b_nx^{(n-1)}$ formed of a high-order equation which passes through different coordinates $(x_3, y_3)$. The method of calculating various types of characteristic curves selects prescribed coordinates $(x_1, y_1)$ on the characteristic curve Y1 and corresponding prescribed coordinates $(x_2, y_2)$ on the characteristic curve Y2, and calculates and outputs a characteristic curve $\mathbf{Y3}=b_1+b_2x+b_3x^2+\ldots+b_nx^{(n-1)}$ formed of a high-order equation which passes through different coordinates $(x_3, y_3)$, with use of an equation $b_n=\{a_{1n}kh_1(1/kq_1)^{(n-1)}\times(y_3-y_2)/(y_1-y_2)\}+\{a_{2n}kh_2(1/kq_2)^{(n-1)}\times(y_1-y_3)/(y_1-y_2)\}$.

6 Claims, 6 Drawing Sheets

METHOD FOR CALCULATING CHARACTERISTIC CURVE OF CENTRIFUGAL FLUID MACHINE BY COMPUTER

TECHNICAL FIELD

The present invention relates to a computer-implemented method of calculating various types of characteristic curves of a centrifugal fluid machine (pump or the like), and a computer-readable storage medium having a program recorded thereon for calculating various types of characteristic curves of a centrifugal fluid machine. The present invention also relates to a computer-implemented method of geometrically converting coordinates in drawing a high-order curve, and a computer-readable storage medium having a program recorded thereon for geometrically converting coordinates in drawing a high-order curve.

BACKGROUND ART

When customers have requested a pump having a prescribed performance (desired flow rate and head), the following method has heretofore been employed to supply a pump that meets the desired performance.

First, a pump capable of providing the requested performance (flow rate and head) is selected from among numerous types of pumps. Specifically, as shown in FIG. 6, a pump is selected to have such characteristics that coordinates A1 which are determined by the requested flow rate and head are located between a flow-head characteristic curve (Q-H characteristic curve) Y1 with an impeller having a diameter of 100 mm and a flow-head characteristic curve (Q-H characteristic curve) Y2 with an impeller having a diameter of 50 mm, or half the size, in the cases where parts other than an impeller housed in a pump casing are not changed, but the impeller is changed only in diameter. In other words, the Q-H characteristic curves Y1 and Y2 are calculated for a plurality of types of pumps in advance, and pumps having pump characteristics which are located between the curves Y1 and Y2 are selected from the plurality of types of pumps.

It is possible to obtain a pump with the required flow rate by setting the diameter of the impeller of the selected pump to 100 mm and throttling the opening of the valve mounted on the discharge port of the pump to raise the head against the flow rate on the Q-H characteristic curve Y1.

However, since an unnecessary increase in head is caused by throttling the opening of the valve in this method, loss of the motor power or the like is increased, and hence the running cost is problematically increased due to the increase in electric power consumption.

In order to solve the above problems, there has been proposed a method of selecting an impeller having such a diameter that a Q-H characteristic curve passes through the requested flow rate and head, rather than a method of simply setting the diameter of the impeller housed in the pump casing to 100 mm.

The following method is employed to select such an impeller, for example. In FIG. 7, a Q-H characteristic curve Y3 which is located intermediately between the Q-H characteristic curves Y1 and Y2 is calculated, and then it is determined whether the curve Y3 passes through the coordinates A1 for the requested flow rate and head. When the coordinates A1 are larger than the Q-H characteristic curve Y3, a Q-H characteristic curve Y4 which is located intermediately between the Q-H characteristic curves Y1 and Y3 is calculated, and then it is determined whether the curve Y4 passes through the coordinates A1. This process of calculations is repeated until a Q-H curve passing through the coordinates A1 is found. Based on the Q-H characteristic curve passing through the coordinates A1 that is found above, the diameter of the impeller is calculated, and a pump incorporating the impeller having the calculated diameter is provided to the customer.

The following method has heretofore employed to calculate the Q-H characteristic curve Y3 located intermediately between the two Q-H characteristic curves Y1 and Y2 in FIG. 7, based on these two Q-H characteristic curves Y1 and Y2. As shown in FIG. 8, this method employs two Q-H characteristic curves $Y_H$1 and $Y_H$2 and Q-E characteristic curves (flow-efficiency characteristic curves) $Y_E$1 and $Y_E$2 which correspond to the Q-H characteristic curves $Y_H$1 and $Y_H$2, respectively. The flow rates are calculated at a plurality of points on the Q-E characteristic curves $Y_E$1 and $Y_E$2 which have the same efficiency, including P11 and P21, P12 and P22, P13 and P23, P14 and P24, P15 and P25, and P16 and P26. The heads corresponding to the respective flow rates are then calculated. Although P16 and P26 are the best efficiency points, respectively, and do not have the same efficiency, they are assumed to have the same efficiency in this example.

For example, with regard to the points P11 and P21, flow rates Q11 and Q21 which correspond to an efficiency $E_{R1}$ are calculated at the points P11 and P21. However, it is not easy to calculate the flow rates Q11 and Q21 on the X-axis from the efficiency $E_{R1}$ on the Y-axis in a high-order curve, but many calculations are required. Moreover, since the number of points at which the flow rates are calculated is 12 in this example, the similar calculations should be performed 12 times.

Next, the flow rates Q11 and Q21 are substituted for the two Q-H characteristic curves $Y_H\mathbf{1}=f_H\mathbf{1}(x)$ and $Y_H\mathbf{2}=f_H\mathbf{2}(x)$ to calculate the respective heads H11 and H21 which correspond to the flow rates Q11 and Q21 calculated above. The other heads are also calculated in the similar manner.

A coordinate point R1 ($Q_{R1}$, $H_{R1}$) is estimated with the following equations from the calculated flow rates Q11 and Q21 and the calculated heads H11 and H21. The other coordinate points R2–R6 are also calculated in the similar manner.

$$H_{R1}=\{(H\mathbf{11}-H\mathbf{21})/2\}+H\mathbf{21}$$

$$Q_{R1}=\{(Q\mathbf{11}-Q\mathbf{21})/2\}+Q\mathbf{21}$$

A new Q-H characteristic curve $Y_H$3 is then calculated by the least-square approximation of the sequence of the calculated coordinate points R1–R6.

Next, because a coordinate point S1 ($Q_{R1}$, $E_{R1}$) on a Q-E characteristic curve $Y_E$3 which corresponds to the calculated Q-H characteristic curve $Y_H$3 has been calculated in the above calculation, the Q-E characteristic curve $Y_E$3 is calculated by the least-square approximation of the sequence of the calculated coordinate points S1–S6.

Complicated and massive calculations are required to derive a high-order equation with the least-square method. Since such calculations should be performed for deriving two high-order equations for the Q-H characteristic curve $Y_H$3 and the Q-E characteristic curve $Y_E$3, further massive calculations are required.

Then, it is determined whether the Q-H characteristic curve $Y_H$3 calculated with the above method passes through the coordinates A1 for the requested flow rate and head as described with reference to FIG. 7. If the Q-H characteristic curve $Y_H$3 does not pass through the coordinates A1, the above calculation is repeated.

Assuming that the calculations for calculating the Q-H characteristic curve and the Q-E characteristic curve are repeated five times, for example, a value on the X-axis should be calculated from a value on the Y-axis in the high-order equation 60 times, and the least-square approximation should be performed 10 times. Therefore, it is necessary to perform massive and complicated calculations, which cannot be performed on a personal computer at a practical speed but requires a host computer.

The performance curve for a pump, such as the Q-H characteristic curve described above, is usually expressed by representing the flow rate as [$m^3$/min] on the horizontal axis and the head as [m] on the vertical axis. While this system of units (coordinates) is usually used in Japan, the Q-H characteristic curve should be displayed with another system of units (coordinates) of another country in the case of selling products in that country, for example. Specifically, it may be necessary to display a Q-H characteristic curve in [USG(US gallon)/min] on the horizontal axis and in [feet] on the vertical axis, for example.

The following method has heretofore been employed to convert a characteristic curve expressed in a prescribed system of units (coordinates) into a characteristic curve (high-order curve) expressed in a different system of units (coordinates) by conversion of the units for drawing the converted characteristic curve with a computer. First, values of a plurality of points (x, y) on the characteristic curve which is formed from a high-order equation expressed in the prescribed system of units (coordinates) are calculated. Next, these values are converted into values of a plurality of points (x, y) in a different desired system of units (coordinates) by conversion of the units. The coefficients for each of orders in the high-order equation passing through the plurality of calculated points are calculated by the least-square approximation using the least-square method. The results are drawn as a characteristic curve converted into the desired units.

However, as described above, complicated and massive calculations are required to derive the high-order equation by the least-square method, and hence such calculations take a large amount of time even with use of a computer. Further, the calculated characteristic curve is not necessarily accurate.

DISCLOSURE OF INVENTION

The present invention has been made in view of the above drawbacks. It is therefore a first object of the present invention to provide a computer-implemented method of calculating various types of characteristic curves of a centrifugal fluid machine and a computer-readable storage medium having a program recorded thereon for calculating various types of characteristic curves of a centrifugal fluid machine which can easily calculate a Q-H characteristic curve, a Q-E characteristic curve, a Q-NPSH characteristic curve, or the like.

A second object of the present invention is to provide a computer-implemented method of geometrically converting coordinates in drawing a high-order curve and a computer-readable storage medium having a program recorded thereon for geometrically converting coordinates in drawing a high-order curve which can reduce time required for calculations and can obtain an accurate high-order curve (performance curve).

In order to attain the first object, according to the present invention, there is provided a computer-implemented method of calculating various types of characteristic curves of a centrifugal fluid machine, wherein two prescribed characteristic curves Y1=$a_{11}+a_{12}x+a_{13}x^2+\ldots+a_{1n}x^{(n-1)}$ and Y2=$a_{21}+a_{22}x+a_{23}x^2+\ldots+a_{2n}x^{(n-1)}$ formed of high-order equations for a centrifugal fluid machine are used to calculate a characteristic curve Y3=$b_1+b_2x+b_3x^2+\ldots+b_nx^{(n-1)}$ formed of a high-order equation which passes through different coordinates ($x_3$, $y_3$), the method characterized by comprising: selecting prescribed coordinates ($x_1$, $y_1$) on the characteristic curve Y1 and corresponding prescribed coordinates ($x_2$, $y_2$) on the characteristic curve Y2; and calculating and outputting a characteristic curve Y3=$b_1+b_2x+b_3x^2+\ldots+b_nx^{(n-1)}$ formed of a high-order equation which passes through different coordinates ($x_3$, $y_3$), with use of an equation $b_n=\{a_{1n}kh_1(1/kq_1)^{(n-1)}\times(y_3-y_2)/(y_1-y_2)\}+\{a_{2n}kh_2(1/kq_2)^{(n-1)}\times(y_1-y_3)/(y_1-y_2)\}$, wherein $kq_1$ is a ratio ($=x_3/x_1$) of the selected coordinate $x_1$ and the different coordinate $x_3$, $kh_1$ is a ratio ($=y_3/y_1$) of the selected coordinate $y_1$ and the different coordinate $y_3$, $kq_2$ is a ratio ($=x_3/x_2$) of the selected coordinate $x_2$ and the different coordinate $x_3$, and $kh_2$ is a ratio ($=y_3/y_2$) of the selected coordinate $y_2$ and the different coordinate $y_3$.

The characteristic curves Y1, Y2, and Y3 can be applied to flow-head characteristic curves, flow-efficiency characteristic curves, or flow-net positive suction head characteristic curves. When a flow-head characteristic curve is selected, for example, the required characteristic curve is calculated as described below.

Specifically, a computer-implemented method of calculating a flow-head characteristic curve of a centrifugal fluid machine uses two prescribed flow-head characteristic curves Y1=$a_{11}+a_{12}x+a_{13}x^2+\ldots+a_{1n}x^{(n-1)}$ and Y2=$a_{21}+a_{22}x+a_{23}x^2+\ldots+a_{2n}x^{(n-1)}$ formed of high-order equations for a centrifugal fluid machine to calculate a flow-head characteristic curve Y3=$b_1+b_2x+b_3x^2+\ldots+b_nx^{(n-1)}$ formed of a high-order equation which passes within permissible values for an inputted different flow rate Qr and head Hr; selects a head H1 for a flow rate Q1 at the best efficiency point on the flow-head characteristic curve Y1, a head H2 for a flow rate Q2 at the best efficiency point on the flow-head characteristic curve Y2, and a head H3 for a flow rate Q3 at the best efficiency point on a desired provisional flow-head characteristic curve Y3=$b_1+b_2x+b_3x^2+\ldots+b_nx^{(n-1)}$ formed of a high-order equation; and calculates a new flow-head characteristic curve Y3 with use of an equation $b_n=\{a_{1n}kh_1(1/kq_1)^{(n-1)}\times(H3-H2)/(H1-H2)\}+\{a_{2n}kh_2(1/kq_2)^{(n-1)}\times(H1-H3)/(H1-H2)\}$, and outputs the flow-head characteristic curve Y3 when the flow-head characteristic curve Y3 passes within permissible values for the inputted different flow rate Qr and head Hr, and otherwise corrects respective coefficients of the equation Y3=$b_1+b_2x+b_3x^2+\ldots+b_nx^{(n-1)}$ and recalculates a head H3 for the flow rate Q3 at the best efficiency point on the flow-head characteristic curve Y3 using the corrected coefficients, wherein $kq_1$ is a ratio (=Q3/Q1) of the selected flow rates Q1 and Q3, $kh_1$ is a ratio (=H3/H1) of the selected heads H1 and H3, $kq_2$ is a ratio (=Q3/Q2) of the selected flow rates Q2 and Q3, and $kh_2$ is a ratio (=H3/H2) of the selected heads H2 and H3.

Further, according to the present invention, there is provided a computer-readable storage medium having a program recorded thereon for executing a procedure with a computer, the procedure comprising: selecting prescribed coordinates ($x_1$, $y_1$) on a characteristic curve Y1 and corresponding prescribed coordinates ($x_2$, $y_2$) on a characteristic curve Y2 using the two prescribed characteristic curves Y1=$a_{11}+a_{12}x+a_{13}x^2+\ldots+a_{1n}x^{(n-1)}$ and Y2=$a_{21}+a_{22}x+a_{23}x^2+\ldots+a_{2n}x^{(n-1)}$ formed of high-order equations for a centrifugal fluid machine; selecting prescribed coordinates ($x_3$, $y_3$) on a characteristic curve Y3 formed of a high-order equation indicating a desired equation $Y3=b_1+b_2x+b_3x^2+\ldots+b_nx^{(n-1)}$; and calculating and outputting a characteristic curve $Y3=b_1+b_2x+b_3x^2+\ldots+b_nx^{(n-1)}$ formed of a high-order equation which passes through the coordinates ($x_3$, $y_3$), with use of an equation $b_n=\{a_{1n}kh_1(1/kq_1)^{(n-1)}\times(y_3-y_2)/(y_1-y_2)\}+\{a_{2n}kh_2(1/kq_2)^{(n-1)}\times(y_1-y_3)/(y_1-y_2)\}$, wherein $kq_1$ is a ratio ($=x_3/x_1$) of the selected coordinates $x_1$ and $x_3$, $kh_1$ is a ratio ($=y_3/y_1$) of the selected coordinates $y_1$ and $y_3$, $kq_2$ is a ratio ($=x_3/x_2$) of the selected coordinates $x_2$ and $x_3$, and $kh_2$ is a ratio ($=y_3/y_2$) of the selected coordinates $y_2$ and $y_3$.

According to the present invention, by direct X-Y coordinate transformation of a flow-head characteristic curve of a high-order equation, a flow-head characteristic curve of a different high-order equation can easily be calculated, and hence it is not necessary to calculate the X coordinate from the Y coordinate as in the conventional example. Further, it is not necessary to calculate a high-order equation by the least-square method, thereby enabling practical and fast calculations at a processing speed suitable for a personal computer.

In order to attain the second object, according to the present invention, there is provided a computer-implemented method of converting coordinates in drawing a high-order curve, wherein a high-order curve $Y1=a_1+a_2x+a_3x^2+\ldots+a_nx^{(n-1)}$ expressed in prescribed coordinates is converted into a high-order curve $Y2=b_1+b_2x+b_3x^2+\ldots+b_nx^{(n-1)}$ expressed in different coordinates for drawing the converted high-order curve with a computer, the method characterized by comprising: calculating a geometric conversion coefficient $k_x$ (=a value of the different coordinate/a value of the prescribed coordinate) for the direction of the X coordinate axis and a geometric conversion coefficient $k_y$ (=a value of a different coordinate/a value of a prescribed coordinate) for the direction of the Y coordinate axis; and calculating respective coefficients $b_n$ (n=1–n) of the equation $Y2=b_1+b_2x+b_3x^2+\ldots+b_nx^{(n-1)}$ according to an equation $b_n=a_n\times k_y/(k_x)^{(n-1)}$ with use of the coefficients $a_n$ (n=1–n) for each of orders of the high-order curve Y1 and the geometric conversion coefficients $k_x$ and $k_y$, and substituting the coefficients $b_n$ for the equation $Y2=b_1+b_2x+b_3x^2+\ldots+b_nx^{(n-1)}$ to convert the high-order curve Y1 into the high-order curve Y2.

Further, according to the present invention, there is provided a computer-readable storage medium having a program recorded thereon for executing a procedure with a computer, the procedure comprising: calculating a geometric conversion coefficient $k_x$ (=a value of a different coordinate/a value of a prescribed coordinate) for the direction of the X coordinate axis and a geometric conversion coefficient $k_y$ (=a value of the different coordinate/a value of the prescribed coordinate) for the direction of the Y coordinate axis for converting between a high-order curve $Y1=a_1+a_2x+a_3x^2+\ldots+a_nx^{(n-1)}$ expressed in the prescribed coordinates and a high-order curve $Y2=b_1+b_2x+b_3x^2+\ldots+b_nx^{(n-1)}$ expressed in the different coordinates; calculating respective coefficients $b_n$ (n=1–n) of the equation $Y2=b_1+b_2x+b_3x^2+\ldots+b_nx^{(n-1)}$ according to an equation $b_n=a_n\times k_y/(k_x)^{(n-1)}$ with use of the coefficients $a_n$ (n=1–n) for each of orders of the high-order curve Y1 and the geometric conversion coefficients $k_x$ and $k_y$, and substituting the coefficients for the equation $Y2=b_1+b_2x+b_3x^2+\ldots+b_nx^{(n-1)}$ to convert the high-order curve Y1 into the high-order curve Y2; and drawing the converted high-order curve Y2.

According to the present invention, coordinates of a high-order curve can geometrically be converted simply by converting respective coefficients each of orders of a function. Moreover, the calculated performance curve is accurate.

BEST MODE FOR CARRYING OUT THE INVENTION

An embodiment of the present invention will be described below in detail with reference to FIGS. 1 through 5.

Figure 1:
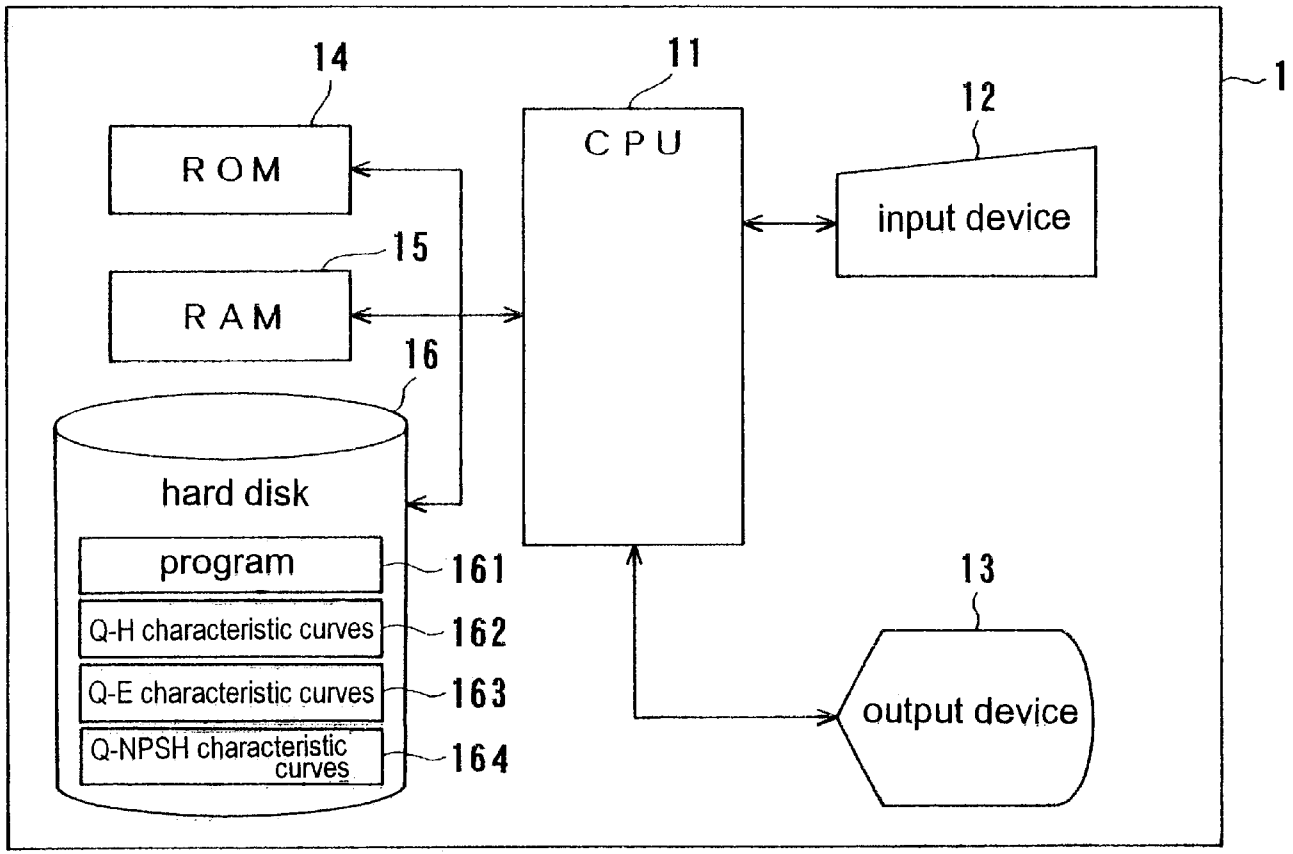
FIG. 1 is a block diagram showing an example of a hardware configuration of a computer used in an embodiment of the present invention.

FIG. 1 is a block diagram showing an example of a hardware configuration of a computer used in the present embodiment. The computer 1 in the present embodiment is configured of a common computer or the like. As shown in FIG. 1, the computer 1 comprises a central processing unit (CPU) 11, an input device 12 such as a keyboard or a mouse, an output device 13 such as a display, and storage devices including a ROM 14, a RAM 15, and a hard disk 16.

A computer program 161 for issuing commands to the CPU 11 and the like in cooperation with an operating system (OS) to perform prescribed processes is stored with the hard disk 16 in the computer 1. The computer program 161 is loaded into the RAM 15 and executed in cooperation with the CPU 11 for performing various processes described later.

Further, Q-H characteristic curves 162 for pumps having various performances, and Q-E characteristic curves 163 and Q-NPSH characteristic curves 164 (flow-net positive suction head characteristic curves) which correspond to the Q-H characteristic curves 162 are stored in the hard disk 16 serving as a storage device.

The computer program 161, the Q-H characteristic curves 162, the Q-E characteristic curves 163, and the Q-NPSH characteristic curves 164 may be stored in another storage device other than the hard disk 16.

Figure 2:
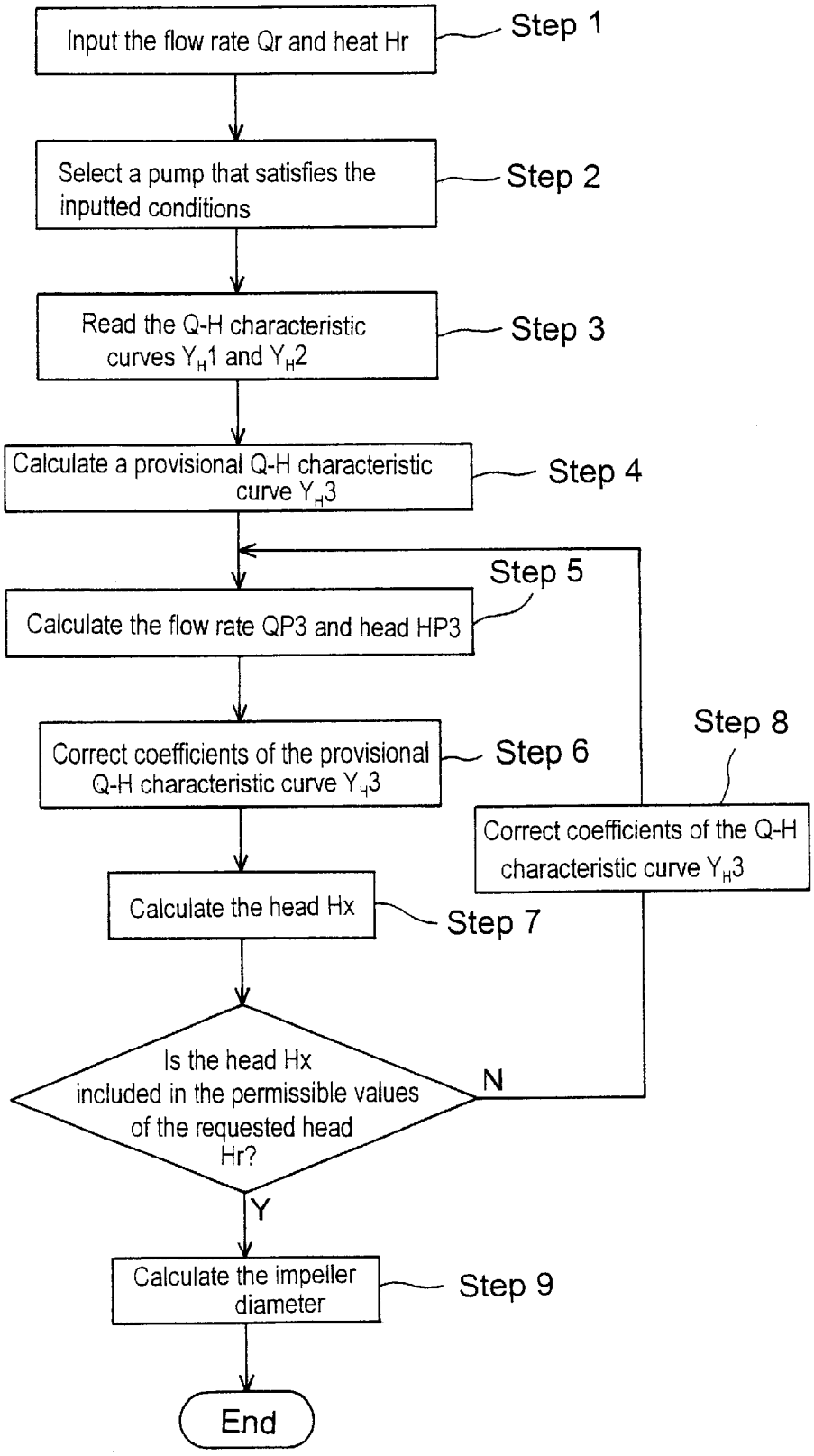
FIG. 2 is a flowchart showing the procedure for selecting a centrifugal fluid machine in an embodiment of the present invention.

Next, the procedure for selecting a centrifugal fluid machine with use of the computer 1 will be described below. FIG. 2 is a flow chart showing the procedure for selecting a centrifugal fluid machine.

Figure 3:
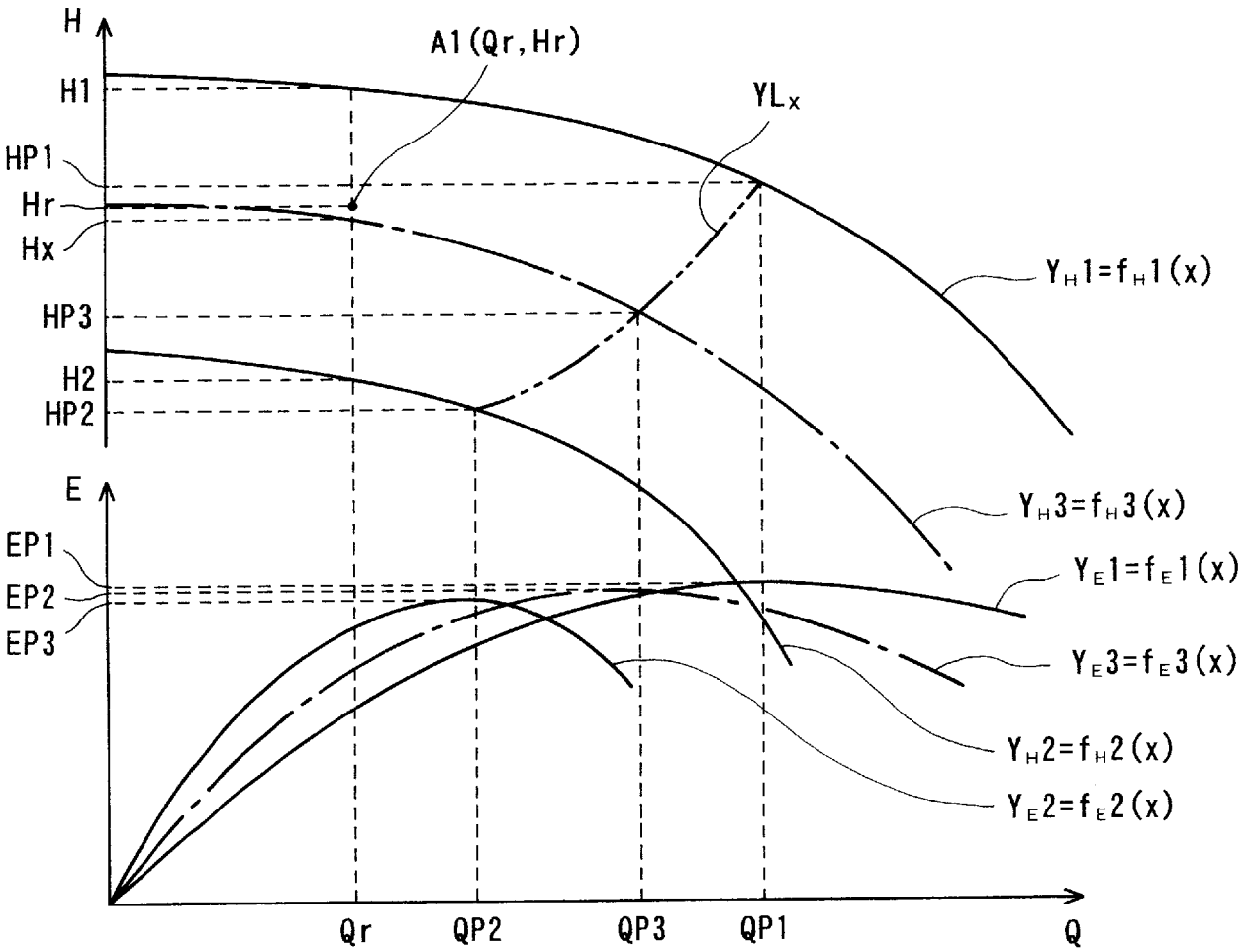
FIG. 3 is a pump characteristic curve explanatory of a method according to the present invention.

Here, there will be described an example where, when a customer requests a pump having a prescribed performance (desired flow rate and head, i.e., (Qr, Hr)), a pump capable of providing a required performance (flow rate and head) is selected. Specifically, as shown in FIG. 3, a pump is selected to have such characteristics that coordinates A1 which are determined by the requested flow rate Qr and head Hr are located between a Q-H characteristic curve $Y_H$1 with an impeller having a diameter of 100 mm and a Q-H characteristic curve $Y_H2$ with an impeller having a diameter of 50 mm, or half the size, in the cases where parts other than an impeller housed in a pump casing are not changed, but the impeller is changed only in diameter.

In this case, values for the requested flow rate Qr and head Hr are inputted with the input device 12 such as a keyboard or mouse (Step 1). Then, a pump that satisfies the above inputted conditions is selected based on the Q-H characteristic curves $Y_H1$ and $Y_H2$ of pumps having various performances which are prestored in the hard disk 16 of the selecting apparatus (Step 2).

Next, with respect to the selected pump, the Q-H characteristic curve $Y_H1$ for an impeller having a diameter of 100 mm and the Q-H characteristic curve $Y_H2$ for an impeller having a diameter of 50 mm are read as high-order equations (the following equations (1) and (2)) (Step 3). The equations (1) and (2) are stored in the hard disk 16 as actual measured values for operating the pumps and can be read therefrom.

$$f1(x)=a_{11}+a_{12}x+a_{13}x^2+\ldots+a_{1n}x^{(n-1)} \quad (1)$$

$$f2(x)=a_{21}+a_{22}x+a_{23}x^2+\ldots+a_{2n}x^{(n-1)} \quad (2)$$

A provisional Q-H characteristic curve $Y_H3$ is calculated from these Q-H characteristic curves $Y_H1$ and $Y_H2$ (Step 4), and then a flow rate QP3 and a head HP3 are calculated at the best efficiency point on the provisional Q-H characteristic curve $Y_H3$ (Step 5). The X-Y coordinate transformation and the component composition of the respective coefficients of the Q-H characteristic curve $Y_H3$ is performed to calculate a Q-H characteristic curve $Y_H3$ approaching the true Q-H characteristic curve $Y_H3$ (Step 6). The required flow rate Qr is substituted for the Q-H characteristic curve $Y_H3$ to calculate a head Hx (Step 7). If the calculated head Hx is included in the permissible values of the requested head Hr, then the loop ends and the step (Step 9) for calculating the next impeller diameter is performed. If the calculated head Hx is not included in the permissible values of the requested head Hr, then the coefficients of the Q-H characteristic curve $Y_H3$ are corrected (Step 8) and the process returns to Step 5. This loop is repeated.

Next, Steps 4–8 described above will be described in more detail.

Step 4: Initialization Process

The following steps are performed to establish an initial assumed Q-H characteristic curve. Specifically, the requested flow rate Qr is substituted for the variable x of each of the upper and lower Q-H characteristic curves $Y_H1$ and $Y_H2$ to calculate corresponding heads H1 and H2 (see FIG. 3).

Next, internally divided head ratios for the requested flow Hr are multiplied by the respective coefficients for each of orders in the upper and lower Q-H characteristic curves $Y_H1$ and $Y_H2$ to calculate respective coefficients $a_n$ for the initial assumed Q-H characteristic curve $Y_H3$ (=$f_H3(x)$). The $a_n$ is calculated by the following equation.

$$a_n=a_{1n}\times\{(Hr-H2)/(H1-H2)\}+a_{2n}\times\{(H1-Hr)/(H1-H2)\}$$

The provisionally assumed Q-H characteristic curve is initially set to be as close to the desired Q-H characteristic curve as possible. It is not necessary to use this characteristic curve, but another suitable curve may be used.

Next, Q-E characteristic curves $Y_E1$ (=$f_E1(x)$) and $Y_E2$ (=$f_E2(x)$) corresponding to the upper and lower Q-H characteristic curves $Y_H1$ and $Y_H2$ are read from the hard disk 16. The flow rates (QP1, QP2) at the respective best efficiency points and the heads (HP1, HP2) corresponding to these flow rates are calculated on the Q-H characteristic curves $Y_H1$ and $Y_H2$.

Next, in the following equation which passes through the two points (QP1, HP1) and (QP2, HP2), coefficients AA and BB in a linear equation with respect to logarithm (base 10) are calculated.

$$YLx=10^{\{AA\times Log(QPx)+BB\}}$$

The coefficients AA and BB are calculated by the following equations.

$$AA=\{\mathrm{Log}(HP2)-\mathrm{Log}(HP1)\}/\{\mathrm{Log}(QP2)-\mathrm{Log}(QP1)\}$$

$$BB=\{\mathrm{Log}(HP1)-AA\ \mathrm{Log}(QP1)\}$$

It has been presumed that the locus of flow-head movement corresponding to the best efficiency point of the pump moves according to an exponent of Log. The linear equation YLx expresses this locus. Specifically, since the locus of flow-head movement at the best efficiency points is determined by the linear equation YLx shown in FIG. 3, the flow-head at the best efficiency points is on this linear equation YLx, and hence the linear equation YLx is calculated in order to derive the Q-H characteristic curve $Y_H3$ passing through the required flow (Qr, Hr).

Step 5: Calculation of the Intersection Point

Next, the value of the flow rate QP3 at the point of intersection between the provisional Q-H characteristic curve $Y_H3$ calculated above and the curve YLx calculated above is calculated by calculus of finite differences. Specifically, a point located intermediately between QP1 and QP2 is temporarily set as QP3. The value for QP3 is calculated according to QP3=QP2+(QP1−QP2)/2. This value is substituted for the respective equations $Y_H3$ and YLx to determine whether or not the two values are equivalent. If the value of the equation $Y_H3$ is larger than that of the equation YLx, then QP2 is set to the value of QP3 (if smaller than that of the equation YLx, then QP1 is set to the value of QP3). Again, QP3 is calculated by the above equation, and the same comparison is made until finally QP3 is set at a point that is included in the permissible values.

Then, QP3 calculated above is substituted for x of the provisional Q-H characteristic curve $Y_H3$=$f_H3(x)$ to calculate HP3.

Step 6: Coefficient Correction

Next, coefficients of the provisional Q-H characteristic curve $Y_H3$ are corrected so as to generate a curve passing through the point (QP3, HP3) that approximates the upper and lower Q-H characteristic curves $Y_H1$ and $Y_H2$. Specifically, the X-Y coordinate transformation and the component composition are simultaneously performed on the upper and lower Q-H characteristic curves $Y_H1$ and $Y_H2$ according to equations (3) and (4) below. Here, a ratio $kq_1$ (=QP3/QP1) of QP1 and QP3, a ratio $kh_1$ (=HP3/HP1) of HP1 and HP3, a ratio $kq_2$ (=QP3/QP2) of QP2 and QP3, and a ratio $kh_2$ (=HP3/HP2) of HP2 and HP3 are used for simple expression of the equation (4) below.

Hence, by setting the following equation:

$$f_H3(x)=b_1+b_2x+b_3x^2+\ldots+b_nx^{(n-1)} \quad (3)$$

We obtain:

$$b_n=\{a_{1n}kh_1(1/kq_1)^{(n-1)}\times(HP3-HP2)/(HP1-HP2)\}\}+\{a_{2n}kh_2(1/kq_2)^{(n-1)}\times(HP1-HP3)/(HP1-HP2)\} \quad (4)$$

The provisional Q-H characteristic curve $Y_H3$=$f_H3(x)$ passing through the provisional best efficiency point (QP3, HP3) can be calculated by using these equations.

Step 7: Determination

The requested flow rate Qr is substituted for x in $f_H3(x)$ calculated above to calculate the head Hx. If the head Hx is included in the tolerance range of the requested head Hr, then this Q-H characteristic curve $Y_H3=f_H3(x)$ is established as the desired characteristic curve.

Step 8: Coefficient Correction

If the head Hx is not included in the permissible values, the respective coefficients $a_n$ are corrected as described below in order to more closely approach the desired Q-H characteristic curve $Y_H3=f_H3(x)$.

$$a_n=a_n\times(Hr/Hx)$$

Specifically, when the value of Hr is greater than (less than) Hx, the coefficients are increased (decreased) by the amount of the ratio.

By returning to Step 5 and repeating the process described above, the desired Q-H characteristic curve will eventually be calculated in Step 7 after several loops.

Here, the method of calculating the above equation (4) will be described. The two characteristic curves $Y_H1$ and $Y_H2$ and the desired characteristic curve $Y_H3$ are as follows.

$$f1(x)=a_{11}+a_{12}x+a_{13}x^2+\ldots+a_{1n}x^{(n-1)} \quad (5)$$

$$f2(x)=a_{21}+a_{22}x+a_{23}x^2+\ldots+a_{2n}x^{(n-1)} \quad (6)$$

$$f3(x)=b_1+b_2x+b_3x^2+\ldots+b_nx^{(n-1)} \quad (7)$$

The ratio $kq_1$ for the change in flow rate and the ratio $kh_1$ for the change in head between the characteristic curve $Y_H1$ and the desired characteristic curve $Y_H3$ are substantially fixed at any point. Accordingly, the relationship of the point $(x_3, y_3)$ on the characteristic curve $Y_H3$ with the point $(x_1, y_1)$ on the characteristic curve $Y_H1$ is as follows.

$$x_3=kq_1\times x_1$$

$$f3(x_3)=kh_1\times f1(x_1)$$

Accordingly, when $x_1=x_3/kq_1$ and $f1(x_1)=f3(x_3)/kh_1$ are substituted for the equation (5):

$$f3(x_3)/kh_1=a_{11}+a_{12}(x_3/kq_1)+a_{13}(x_3/kq_1)^2+\ldots+a_{1n}(x_3/kq_1)^{(n-1)}$$

$$f3(x_3)=kh_1\{a_{11}+a_{12}(x_3/kq_1)+a_{13}(x_3/kq_1)^2+\ldots+a_{1n}(x_3/kq_1)^{(n-1)}\}$$

$$=kh_1a_{11}+kh_1a_{12}(x_3/kq_1)+kh_1a_{13}(x_3/kq_1)^2+\ldots+kh_1a_{1n}(x_3/kq_1)^{(n-1)}$$

Hence, if this equation is set as the equation (7), then, $$b_1=kh_1a_{11},\ldots,\ b_n=kh_1a_{1n}(1/kq_1)^{(n-1)}$$

Specifically, $b_n=kh_1a_{1n}(1/kq_1)^{(n-1)}$.

On the other hand, since the ratio $kq_2$ for the change in flow rate and the ratio $kh_2$ for the change in head between the characteristic curve $Y_H2$ and the desired characteristic curve $Y_H3$ are substantially fixed at any point, the relationship between the point $(x_3, y_3)$ on the characteristic curve $Y_H3$ with the point $(x_2, y_2)$ on the characteristic curve $Y_H2$ is calculated in the same manner as described above.

$$b_2=kh_2a_{21},\ldots,\ b_n=kh_2a_{2n}(1/kq_2)^{(n-1)}$$

Specifically, $b_n=kh_2a_{2n}(1/kq_2)^{(n-1)}$.

Although the characteristic curve $Y_H3$ calculated from the characteristic curve $Y_H1$ differs from the characteristic curve $Y_H3$ calculated from the characteristic curve $Y_H2$, it is possible to approach a valid characteristic curve $Y_H3$ by using the internally divided ratio of the respective coefficients. Specifically, $$b_n=\{(b_n \text{ of the equation (8)})\times(y_3-y_2)/(y_1-y_2)\}$$

$$+\{(b_n \text{ of the equation (9)})\times(y_1-y_3)/(y_1-y_2)\}$$

$$=\{a_{1n}kh_1(1/kq_1)^{(n-1)}\times(y_3-y_2)/(y_1-y_2)\}$$

$$+\{a_{2n}kh_2(1/kq_2)^{(n-1)}\times(y_1-y_3)/(y_1-y_2)\}$$

Thus, the equation (4) described above can be calculated.

In other words, by simply converting the coefficients for each of orders of the functions, it is possible to calculate the characteristic curve $Y_H3$, which includes the point having the flow rate QP3 and the head HP3, from the Q-H characteristic curves $Y_H1$ and $Y_H2$ of pumps having impeller diameters of 100 mm and 50 mm. The conversion equation is the equation (4).

As described above, according to the present invention, by direct X-Y coordinate transformation of a flow-head characteristic curve of a high-order equation, a flow-head characteristic curve of a different high-order equation can easily be calculated, and hence it is not necessary to calculate the X coordinate from the Y coordinate as in the conventional example. Further, it is not necessary to calculate a high-order equation by the least-square method, thereby enabling practical and fast calculations at a processing speed suitable for a personal computer.

It has been known that the following equation (8) is suitable for calculating the diameter Dr of an impeller that will achieve the desired Q-H characteristic curve $Y_H3$.

$$Dr=D1(Hr/H1)^{(1/NH)} \quad (8)$$

Here, D1: diameter of impeller for achieving the Q-H characteristic curve $Y_H1$ H1: head HP1 in the flow rate of the best efficiency for a pump that achieves the Q-H characteristic curve $Y_H1$ Hr: head HP3 in the flow rate of the best efficiency for a pump that achieves the Q-H characteristic curve $Y_H3$ NH: movement coefficient of impeller at the best efficiency point (=Log(HP2/HP1)/Log(D2/D1))

Among the above variables, D1 has been known and H1 and Hr have already been calculated. Further, NH is a coefficient that can be calculated. (Here, HP1 and HP2 are heads at the best efficiency point of each pump, and D1 and D2 are impeller diameters of each pump.) Accordingly, the diameter Dr of the impeller can be calculated by substituting these values for the above equation.

Next, the Q-E characteristic curve $Y_E3=f_E3(x)$ for the pump having the new impeller diameter Dr is calculated as follows. First, QP3 at the best efficiency point (QP3, EP3) on the Q-E characteristic curve $Y_E3$ has been calculated when the Q-E characteristic curve $Y_E3$ is calculated. On the other hand, EP3 can be calculated from $EP3=EP1(Dr/D1)^{NE}$.

Accordingly, by using a ratio $kq_1$ (=QP3/QP1) of QP1 and QP3, a ratio $kh_1$ (=EP3/EP1) of EP1 and EP3, a ratio $kq_2$ (=QP3/QP2) of QP2 and QP3, and a ratio $kh_2$ (=EP3/EP2) of EP2 and EP3, the Q-E characteristic curve $Y_E3$ can immediately be calculated from the following equation.

$$f_E3(x)=b_1+b_2x+b_3x^2+\ldots+b_nx^{(n-1)} \quad (9)$$

Hence, $$b_n=\{a_{1n}kh_1(1/kq_1)^{(n-1)}\times(HP3-HP2)/(HP1-HP2)\}+\{a_{2n}kh_2(1/kq_2)^{(n-1)}\times(HP1-HP3)/(HP1-HP2)\} \quad (10)$$

NE: movement coefficient of impeller at the best efficiency point {=Log(EP2/EP1)/Log(D2/D1)} The $f_E3(x)$ is the desired Q-E characteristic curve $Y_E3$.

Specifically, in the case of the Q-E characteristic curve $Y_E3$, since the upper and lower Q-E characteristic curves $Y_E1$ and $Y_E2$ and the best efficiency point (QP3, EP3) have already known, it is possible to immediately calculate the respective coefficients of the Q-E characteristic curve $Y_E3$ from the equation (10) without performing repeated approximations, as in the conventional solution. (In the case of calculating the Q-H characteristic curve $Y_H3$, since the head and the flow rate at the true best efficiency point have not known, it is necessary to calculate the Q-H characteristic curve $Y_H3$ while approximating this point.)

It is also easy to calculate the Q-NPSH characteristic curve according to the same method as described above.

In this manner, the present invention has an advantageous effect that it is easy to calculate various types of characteristic curves of a centrifugal fluid machine (Q-H characteristic curve, Q-E characteristic curve, Q-NPSH characteristic curve, and the like).

Figure 4:
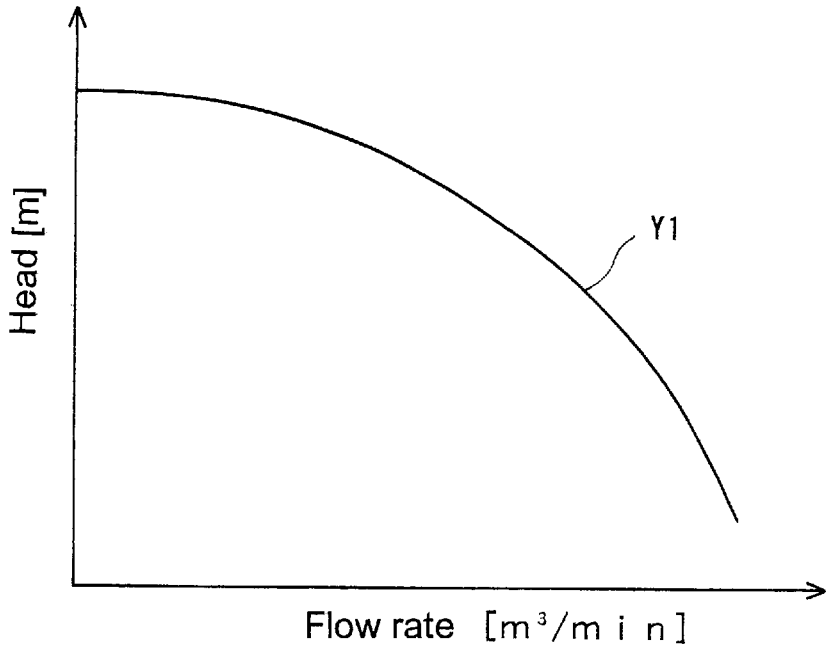
FIG. 4 is a graph showing an example of a flow-head characteristic curve prior to unit conversion.

The Q-H characteristic curve, the Q-E characteristic curve, and the like are outputted to the output device 13 such as a display or a plotter, as needed. Here, the Q-H characteristic curves stored on the hard disk 16 are data (high-order equations) for a system of units (coordinates) represented as [$m^3$/min, m] on the X coordinate axis (horizontal axis) and as [m] on the y coordinate axis (vertical axis), as shown in FIG. 4. It is necessary to display this Q-H characteristic curve for this pump in [USG (US gallon)/min] on the X coordinate axis and in [feet] on the Y coordinate axis in some cases. The present embodiment can cope with such cases.

In such cases, the computer reads from the hard disk 16 the characteristic curve Y1=f1(x) formed of the high-order equation denoted by the equation (11) below, which is expressed in the stored system of units ($m^3$/min, m).

$$f\mathbf{1}(x)=a_1+a_2x+a_3x^2+\ldots+a_nx^{(n-1)} \tag{11}$$

Next, a unit conversion coefficient (geometric conversion coefficient) $k_x$ for the direction of the X coordinate axis and a unit conversion coefficient (geometric conversion coefficient) $k_y$ for the direction of the Y coordinate axis between the system of units ($m^3$/min, m) and the desired different system of units (USG/min, ft) are calculated. Specifically, since one US gallon is equivalent to 0.003785 ($m^3$), the unit conversion coefficient for the direction of the X coordinate axis $k_x=x_2/x_1$, where $x_1$ is the value of the original system of units and $x_1$ is the value of the desired system of units which corresponds to this value. Hence, $k_x=1/0.003785=264.2$. Similarly, since one foot is equivalent to 0.3048 (m), the unit conversion coefficient for the direction of the Y coordinate axis $k_y=y_2/y_1$, where $y_1$ is the value of the original system of units and $y_2$ is the value of the desired system of units which corresponds to this value. Hence, $k_y=1/0.3048=3.2808$.

Next, respective coefficients $b_n$ (n=1−n) in the following equation (12) are calculated according to the following equation (13) by using the coefficients $a_n$ (n=1−n) for each of orders of the performance curve Y1 indicated by the equation (11) and the calculated unit conversion coefficients $k_x$ and $k_y$. Here, the equation (12) is obtained by converting the units of the flow-head characteristic curve in the equation (11) expressed in the system of units ($m^3$/min, m) into the system of units (USG/min, ft).

$$f\mathbf{2}(x)=b_1+b_2x+b_3x^2+\ldots+b_nx^{(n-1)} \tag{12}$$

$$b_n=a_n\times k_y/(k_x)^{(n-1)}=(3.2808)/(264.2)^{(n-1)}\times a_n \tag{13}$$

As described above, according to the present invention, it is possible to calculate respective coefficients of a high-order equation that has been converted in units (geometrically converted in coordinate) only by an algebraic calculation. Accordingly, the present invention can more accurately and immediately convert units of a high-order equation than the conventional method of calculating the respective coefficients of a high-order equation using the least-square method based on a plurality of converted points.

Figure 5:
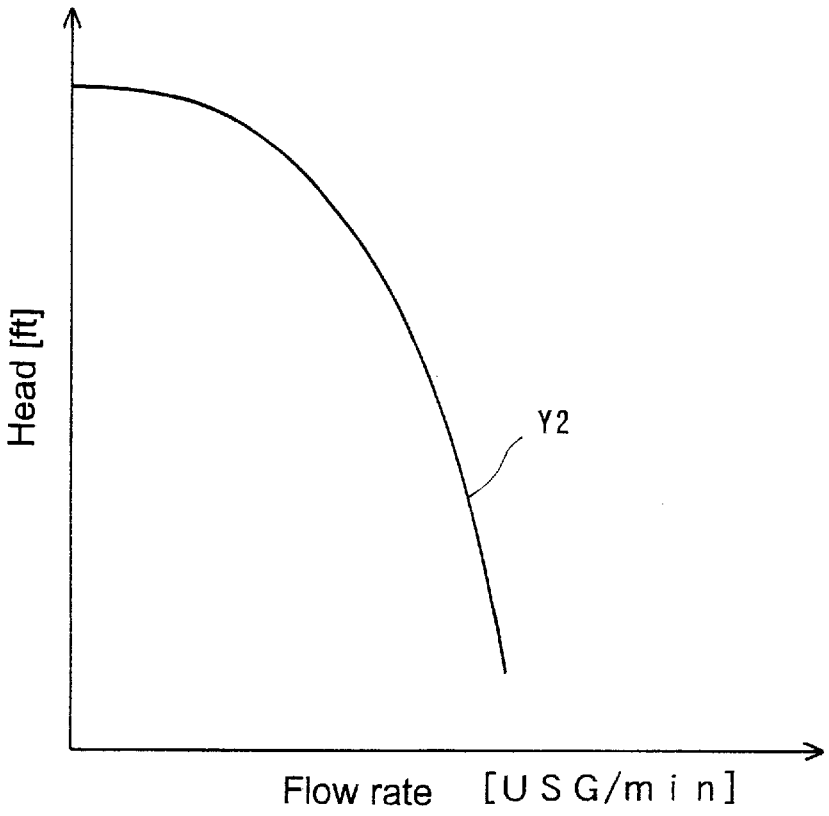
FIG. 5 is a graph showing an example of a flow-head characteristic curve after unit conversion.
Figure 6:
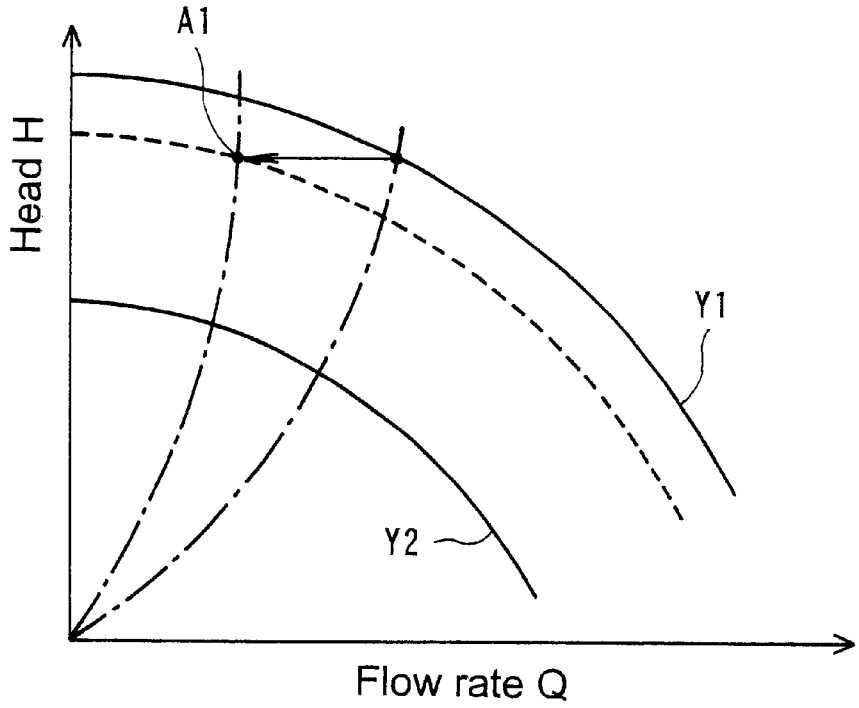
FIG. 6 is a graph showing a pump characteristic curve for describing a conventional method.
Figure 7:
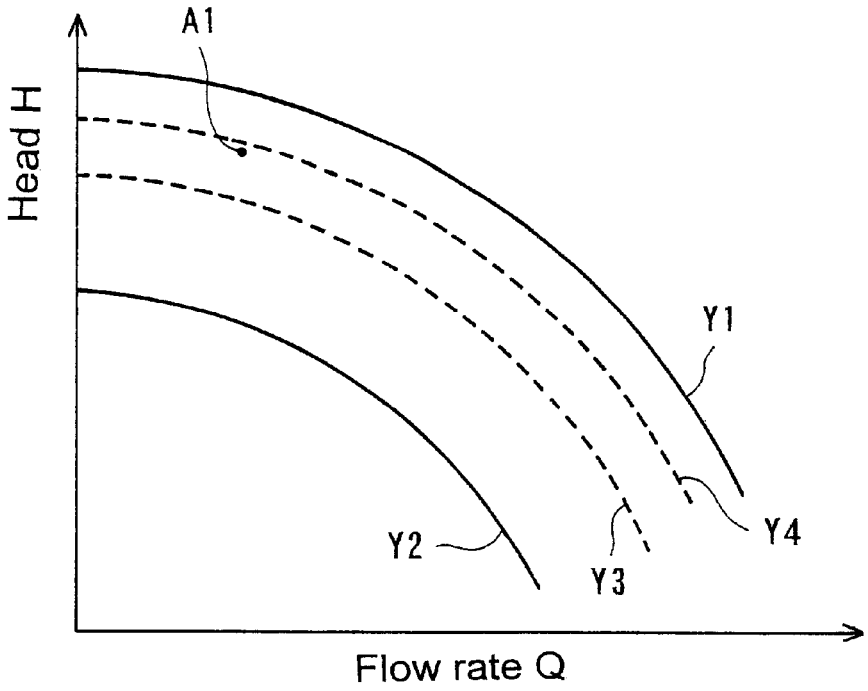
FIG. 7 is a graph showing a pump characteristic curve for describing a conventional method.
Figure 8:
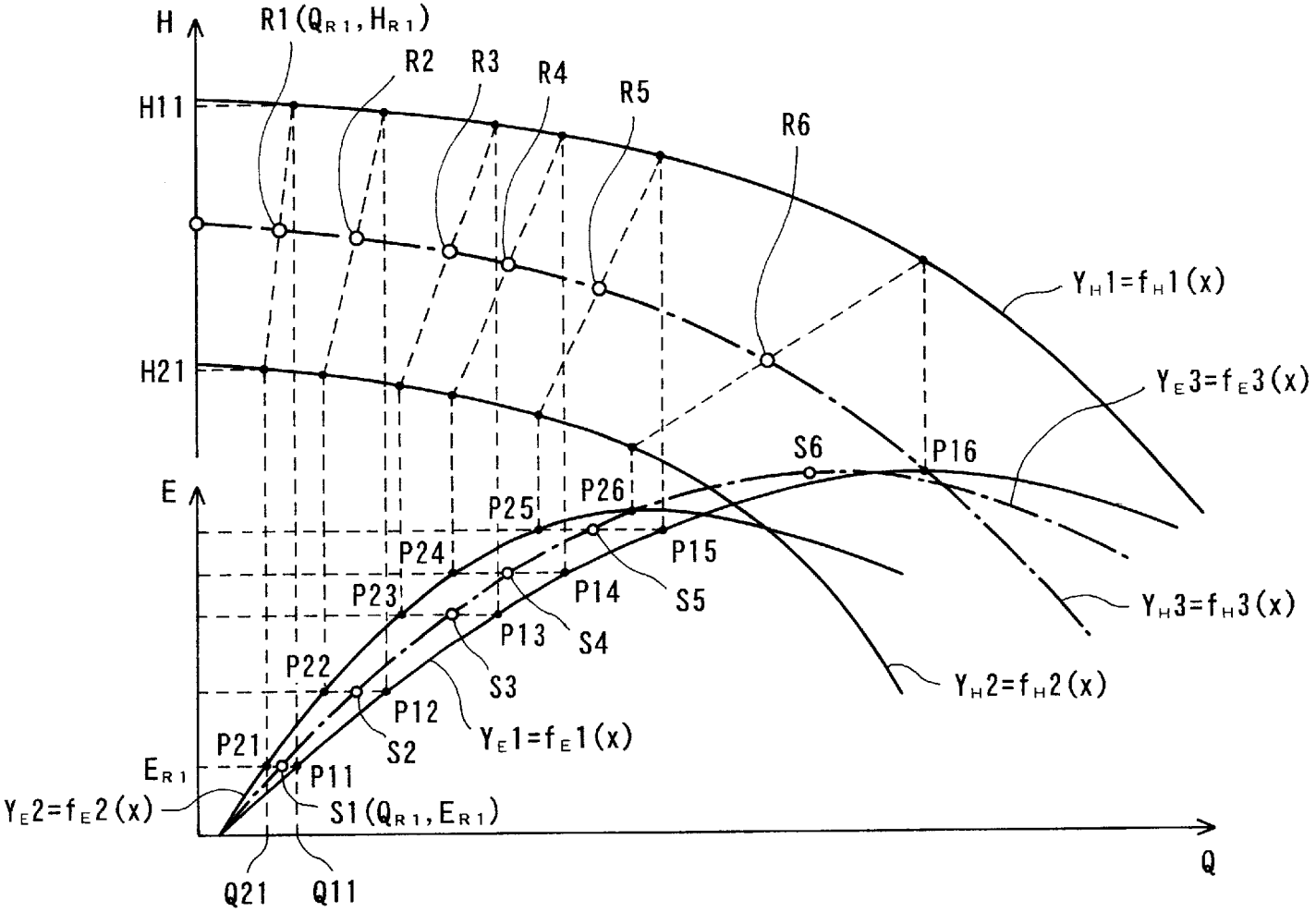
FIG. 8 is a graph showing a pump characteristic curve for describing a conventional method.

The data is drawn with the calculated equation (12) and outputted to an output device 13 such as a CRT or a plotter to display the Q-H characteristic curve as shown in FIG. 5.

Here, a method of calculating the equation (13) will be described. As described above, the prescribed characteristic curve Y1 and the desired characteristic curve Y2 are as follows.

$$f\mathbf{1}(x)=a_1+a_2x+a_3x^2+\ldots+a_nx^{(n-1)} \tag{14}$$

$$f\mathbf{2}(x)=b_1+b_2x+b_3x^2+\ldots+b_nx^{(n-1)} \tag{15}$$

Here, the ratio $k_x$ for the change in the X coordinate and the ratio $k_y$ for the change in the Y coordinate between the characteristic curve Y1 and the desired characteristic curve Y2 are fixed at any points (both of ratios $k_x$, $k_y$ are [desired coordinate]/[known coordinate]). Accordingly, the relationship between the coordinates ($x_2$, $y_2$) on the characteristic curve Y2 with the coordinates ($x_1$, $y_1$) on the characteristic curve Y1 is as follows.

$$x_2=k_x\times x_1$$

$$f\mathbf{2}(x_2)=k_y\times f\mathbf{1}(x_1)$$

Hence, by substituting $x_1=x_2/k_x$ and $f\mathbf{1}(x_1)=f\mathbf{2}(x_2)/k_y$ for the equation (14), the following is obtained.

$$f\mathbf{2}(x_2)/k_y=a_1+a_2(x_2/k_x)+a_3(x_2/k_x)^2+\ldots+a_n(x_2/k_x)^{(n-1)}$$

$$f\mathbf{2}(x_2)=k_y\{a_1+a_2(x_2/k_x)+a_3(x_2/k_x)^2+\ldots+a_n(x_2/k_x)^{(n-1)}\}$$

$$=k_ya_1+k_ya_2(x_2/k_x)+k_ya_3(x_2/k_x)^2+\ldots+k_ya_n(x_2/k_x)^{(n-1)}\} \tag{15}$$

Since this is the equation (15):

$$b_1=k_ya_1,\ \ldots,\ b_n=k_ya_n(1/k_x)^{(n-1)}$$

Therefore, $b_n=k_ya_n(1/k_x)^{(n-1)}$ and the above equation (13) can be calculated.

As described above, the present invention has an advantageous effect that a high-order curve with geometrically converted coordinates can accurately be calculated by a computer in a short amount of time. Hence, only one type of system of units (coordinates) needs to be stored as a database in the computer. The high-order curves for all other system of units (coordinates) can be calculated as needed.

In the present embodiment, a flow-head characteristic curve is used as the high-order curve to be converted, but it is obvious that the present invention is applicable to other types of high-order curves (for example, a flow-efficiency characteristic curve, a flow-power characteristic curve, or a flow-suction loss characteristic curve). Further, the present invention is also applicable to various types of high-order curves of fluid machines other than pumps. In short, the present invention can be applied to any high-order curve as long as the high-order curve needs to be converted.

While the present invention has been described in detail with reference to a specific embodiment thereof, it would be apparent to those skilled in the art that many modifications and variations may be made therein without departing from the spirit of the invention and the scope of which is defined by the attached claims, the specification, and the accompanying drawings. For example, a pump is used as a centrifugal fluid machine in the above embodiment. However, the present invention is applicable to other centrifugal fluid machines used for supplying gas, such as a turbo blower.

INDUSTRIAL APPLICABILITY

The present invention is suitable for a computer-implemented method of calculating various types of characteristic curves of a centrifugal fluid machine, such as a Q-H characteristic curve, a Q-E characteristic curve, a Q-NPSH characteristic curve, or the like, and a computer-readable storage medium having a program recorded thereon for calculating various types of characteristic curves of a centrifugal fluid machine. Further, the present invention is also suitable for a computer-implemented method of geometrically converting coordinates in drawing a high-order curve, and a computer-readable storage medium having a program recorded thereon for geometrically converting coordinates in drawing a high-order curve.

What is claimed is:

1. A computer-implemented method of calculating various types of characteristic curves of a centrifugal fluid machine, wherein two prescribed characteristic curves $\mathbf{Y1}=a_{11}+a_{12}x+a_{13}x^2+\ldots+a_{1n}x^{(n-1)}$ and $\mathbf{Y2}=a_{21}+a_{22}x+a_{23}x^2+\ldots+a_{2n}x^{(n-1)}$ formed of high-order equations for a centrifugal fluid machine are used to calculate a characteristic curve $\mathbf{Y3}=b_1+b_2x+b_3x^2+\ldots+b_nx^{(n-1)}$ formed of a high-order equation which passes through different coordinates $(x_3, y_3)$, said method characterized by comprising:

selecting prescribed coordinates $(x_1, y_1)$ on said characteristic curve Y1 and corresponding prescribed coordinates $(x_2, y_2)$ on said characteristic curve Y2; and calculating and outputting a characteristic curve $\mathbf{Y3}=b_1+b_2x+b_3x^2+\ldots+b_nx^{(n-1)}$ formed of a high-order equation which passes through different coordinates $(x_3, y_3)$, with use of an equation $b_n=\{a_{1n}kh_1(1/kq_1)^{(n-1)}\times(y_3-y_2)/(y_1-y_2)\}+\{a_{2n}kh_2(1/kq_2)^{(n-1)}\times(y_1-y_3)/(y_1-y_2)\}$, wherein $kq_1$ is a ratio $(=x_3/x_1)$ of the selected coordinate $x_1$ and the different coordinate $x_3$, $kh_1$ is a ratio $(=y_3/y_1)$ of the selected coordinate $y_1$ and the different coordinate $y_3$, $kq_2$ is a ratio $(=x_3/x_2)$ of the selected coordinate $x_2$ and the different coordinate $x_3$, and $kh_2$ is a ratio $(=y_3/y_2)$ of the selected coordinate $y_2$ and the different coordinate $y_3$.

2. A computer-implemented method of calculating a flow-head characteristic curve of a centrifugal fluid machine, wherein two prescribed flow-head characteristic curves $\mathbf{Y1}=a_{11}+a_{12}x+a_{13}x^2+\ldots+a_{1n}x^{(n-1)}$ and $\mathbf{Y2}=a_{21}+a_{22}x+a_{23}x^2+\ldots+a_{2n}x^{(n-1)}$ formed of high-order equations for a centrifugal fluid machine are used to calculate a flow-head characteristic curve $\mathbf{Y3}=b_1+b_2x+b_3x^2+\ldots+b_nx^{(n-1)}$ formed of a high-order equation which passes within permissible values for an inputted different flow rate Qr and head Hr, said method characterized by comprising:

selecting a head H1 for a flow rate Q1 at the best efficiency point on said flow-head characteristic curve Y1, a head H2 for a flow rate Q2 at the best efficiency point on said flow-head characteristic curve Y2, and a head H3 for a flow rate Q3 at the best efficiency point on a desired provisional flow-head characteristic curve $\mathbf{Y3}=b_1+b_2x+b_3x^2+\ldots+b_nx^{(n-1)}$ formed of a high-order equation; and calculating a new flow-head characteristic curve Y3 with use of an equation $b_n=\{a_{1n}kh_1(1/kq_1)^{(n-1)}\times(\mathbf{H3}-\mathbf{H2})/(\mathbf{H1}-\mathbf{H2})\}+\{a_{2n}kh_2(1/kq_2)^{(n-1)}\times(\mathbf{H1}-\mathbf{H3})/(\mathbf{H1}-\mathbf{H2})\}$, and outputting said flow-head characteristic curve Y3 when said flow-head characteristic curve Y3 passes within permissible values for said inputted different flow rate Qr and head Hr, and otherwise correcting respective coefficients of said equation $\mathbf{Y3}=b_1+b_2x+b_3x^2+\ldots+b_nx^{(n-1)}$ and recalculating a head H3 for the flow rate Q3 at the best efficiency point on said flow-head characteristic curve Y3 using the corrected coefficients, wherein $kq_1$ is a ratio (=Q3/Q1) of the selected flow rates Q1 and Q3, $kh_1$ is a ratio (=H3/H1) of the selected heads H1 and H3, $kq_2$ is a ratio (=Q3/Q2) of the selected flow rates Q2 and Q3, and $kh_2$ is a ratio (=H3/H2) of the selected heads H2 and H3.

3. A computer-implemented method of calculating various types of characteristic curves of a centrifugal fluid machine according to claim 1, said method characterized in that said characteristic curves Y1, Y2, and Y3 are flow-efficiency characteristic curves.

4. A computer-readable storage medium having a program recorded thereon for executing a procedure with a computer, said procedure comprising:

selecting prescribed coordinates $(x_1, y_1)$ on a characteristic curve Y1 and corresponding prescribed coordinates $(x_2, y_2)$ on a characteristic curve Y2 using the two prescribed characteristic curves $\mathbf{Y1}=a_{11}+a_{12}x+a_{13}x^2+\ldots+a_{1n}x^{(n-1)}$ and $\mathbf{Y2}=a_{21}+a_{22}x+a_{23}x^2+\ldots+a_{2n}x^{(n-1)}$ formed of high-order equations for a centrifugal fluid machine;

selecting prescribed coordinates $(x_3, y_3)$ on a characteristic curve Y3 formed of a high-order equation indicating a desired equation $\mathbf{Y3}=b_1+b_2x+b_3x^2+\ldots+b_nx^{(n-1)}$; and calculating and outputting a characteristic curve $\mathbf{Y3}=b_1+b_2x+b_3x^2+\ldots+b_nx^{(n-1)}$ formed of a high-order equation which passes through said coordinates $(x_3, y_3)$, with use of an equation $b_n=\{a_{1n}kh_1(1/kq_1)^{(n-1)}\times(y_3-y_2)/(y_1-y_2)\}+\{a_{2n}kh_2(1/kq_2)^{(n-1)}\times(y_1-y_3)/(y_1-y_2)\}$, wherein $kq_1$ is a ratio $(=x_3/x_1)$ of the selected coordinates $x_1$ and $x_3$, $kh_1$ is a ratio $(=y_3/y_1)$ of the selected coordinates $y_1$ and $y_3$, $kq_2$ is a ratio $(=x_3/x_2)$ of the selected coordinates $x_2$ and $x_3$, and $kh_2$ is a ratio $(=y_3/y_2)$ of the selected coordinates $y_2$ and $y_3$.

5. A computer-implemented method of converting coordinates in drawing a high-order curve, wherein a high-order curve $\mathbf{Y1}=a_1+a_2x+a_3x^2+\ldots+a_nx^{(n-1)}$ expressed in prescribed coordinates is converted into a high-order curve $\mathbf{Y2}=b_1+b_2x+b_3x^2+\ldots+b_nx^{(n-1)}$ expressed in different coordinates for drawing the converted high-order curve with a computer, said method characterized by comprising:

calculating a geometric conversion coefficient $k_x$ (=a value of the different coordinate/a value of the prescribed coordinate) for the direction of the X coordinate axis and a geometric conversion coefficient $k_y$ (=a value of a different coordinate/a value of a prescribed coordinate) for the direction of the Y coordinate axis; and calculating respective coefficients $b_n$ (n=1−n) of said equation $\mathbf{Y2}=b_1+b_2x+b_3x^2+\ldots+b_nx^{(n-1)}$ according to an equation $b_n=a_n\times k_y/(k_x)^{(n-1)}$ with use of the coefficients $a_n$ (n=1−n) for each of orders of said high-order curve Y1 and said geometric conversion coefficients $k_x$ and $k_y$, and substituting said coefficients $b_n$ for said equation $\mathbf{Y2}=b_1+b_2x+b_3x^2+\ldots+b_nx^{(n-1)}$ to convert said high-order curve Y1 into said high-order curve Y2.

6. A computer-readable storage medium having a program recorded thereon for executing a procedure with a computer, said procedure comprising:

calculating a geometric conversion coefficient $k_x$ (=a value of a different coordinate/a value of a prescribed coordinate) for the direction of the X coordinate axis and a geometric conversion coefficient $k_y$ (=a value of the different coordinate/a value of the prescribed coordinate) for the direction of the Y coordinate axis for converting between a high-order curve Y1=$a_1+a_2x+a_3x^2+\ldots+a_nx^{(n-1)}$ expressed in the prescribed coordinates and a high-order curve Y2=$b_1+b_2x+b_3x^2+\ldots+b_nx^{(n-1)}$ expressed in the different coordinates;

calculating respective coefficients $b_n$ (n=1−n) of said equation Y2=$b_1+b_2x+b_3x^2+\ldots+b_nx^{(n-1)}$ according to an equation $b_n=a_n\times k_y/(k_x)^{(n-1)}$ with use of the coefficients $a_n$ (n=1−n) for each of orders of said high-order curve Y1 and the geometric conversion coefficients $k_x$ and $k_y$, and substituting said coefficients $b_n$ for said equation Y2=$b_1+b_2x+b_3x^2+\ldots+b_nx^{(n-1)}$ to convert said high-order curve Y1 into said high-order curve Y2; and drawing the converted high-order curve Y2.

* * * * *

UNITED STATES PATENT AND TRADEMARK OFFICE

CERTIFICATE OF CORRECTION

PATENT NO. : 6,671,657 B2 
DATED : December 30, 2003
INVENTOR(S) : Shinichi Shigehara et al.

It is certified that error appears in the above-identified patent and that said Letters Patent is hereby corrected as shown below:

Title page,
Item [54], Title, please change to read as follows: -- COMPUTER-IMPLEMENTED METHOD OF CALCULATING CHARACTERISTIC CURVE OF CENTRIFUGAL FLUID MACHINE. --

Signed and Sealed this

Fifteenth Day of June, 2004

JON W. DUDAS
*Acting Director of the United States Patent and Trademark Office*